United States Patent [19]

Bianchi

[11] Patent Number: 4,508,042

[45] Date of Patent: Apr. 2, 1985

[54] NEEDLE CLAMP FOR A SEWING MACHINE

[75] Inventor: Nereo Bianchi, Pavia, Italy

[73] Assignee: NECCHI Societa per Azioni, Pavia, Italy

[21] Appl. No.: 393,887

[22] Filed: Jul. 1, 1982

[30] Foreign Application Priority Data

Jul. 13, 1981 [IT] Italy ..... 42913 A/81

[51] Int. Cl.[3] ..... D05B 55/02

[52] U.S. Cl. ..... 112/226

[58] Field of Search ..... 112/226

[56] References Cited

U.S. PATENT DOCUMENTS

| | | | |
|---|---|---|---|
| 2,973,733 | 3/1961 | Johnson | 112/226 |
| 3,344,761 | 10/1967 | Ross | 112/226 |
| 3,348,508 | 10/1967 | Eguchi et al. | 112/226 |
| 3,583,345 | 6/1971 | Wilson | 112/226 |
| 4,242,975 | 1/1981 | Knowles et al. | 112/226 |
| 4,329,934 | 5/1982 | Hanyu et al. | 112/226 |

FOREIGN PATENT DOCUMENTS

| | | | |
|---|---|---|---|
| 654400 | 10/1964 | Belgium | 112/226 |

*Primary Examiner*—Werner H. Schroeder
*Assistant Examiner*—Andrew M. Falik
*Attorney, Agent, or Firm*—Stevens, Davis, Miller & Mosher

[57] ABSTRACT

A needle clamp, fixed at the lower end of the needle bar of a sewing machine. A guide member is provided in the lower portion of the needle clamp locating a sewing needle in a predetermined position in the needle clamp. The guide member has a cylindrical opening in its upper portion coupling with the extreme lower portion of the needle bar and in its lower portion a guide hole whose section has substantially the shape of the transverse section of the needle shank.

1 Claim, 6 Drawing Figures

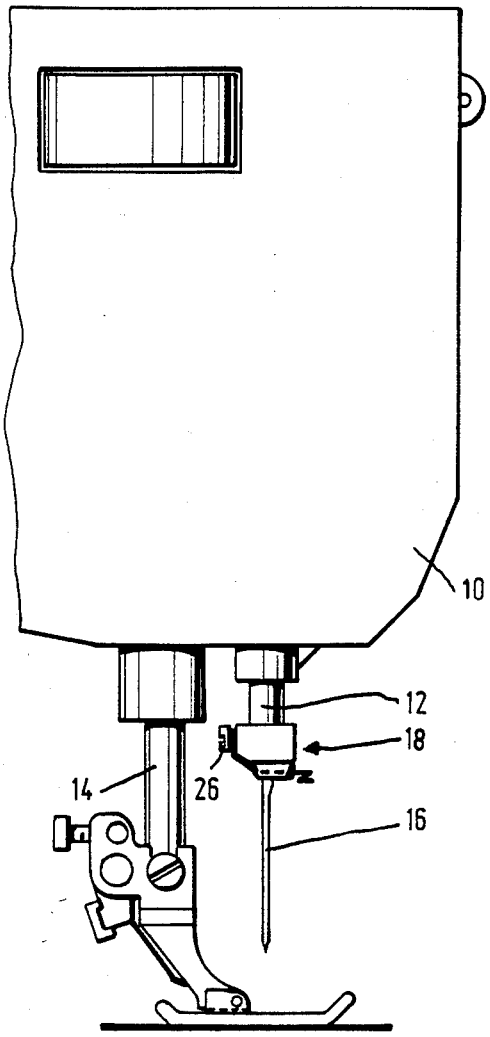
FIG. 1
FIG. 6
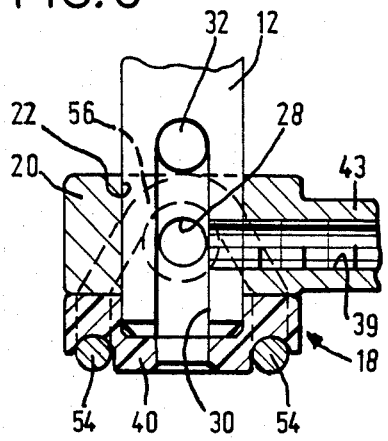
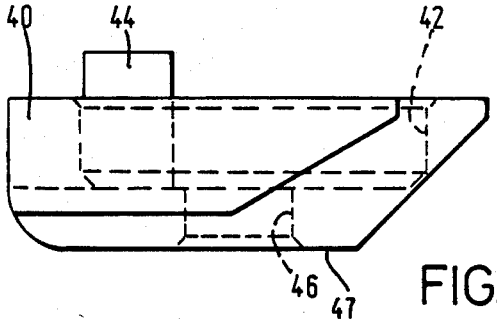
FIG. 3

NEEDLE CLAMP FOR A SEWING MACHINE

DISCLOSURE OF THE INVENTION

The present invention relates to a needle clamp for a sewing machine and more particularly to new means for making easier the mounting of the needle inside the needle groove formed in the needle bar thereby allowing perfect cooperation of the needle with the other instruments for stitch forming.

Devices studied to obtain such an effect are already known in the art. However they are rather complicated and expensive.

The object of the present invention is to provide a method of guiding the needle to be arranged on an usual clamp which must be simple, cheap and rational in working. As it is know, the predetermined position of the needle mounted on the needle bar is determined by giving to the needle shank a particular shape so that a transverse section thereof has a perimetrical cylindrical portion and plane portion, the plane portion being in a predetermined position relative to the position of the needle eye.

The technical problem to be solved in order to obtain the object described was to provide a simple guide element, selective for the different positions of the needle shank to apply to a common needle clamp in order to guide the needle in its right position inside the suitable needle groove provided in the needle bar.

The solution of the technical problem is characterized by the fact that the guide member is provided with an upper central cylindrical opening coupling with the lower portion of the needle bar, a hole having substantially the shape of the transverse section of the needle shank, obtained in the lower portion of the guide member as a continuation of the cylindrical opening, and means being provided to support the guide member in contact with the lower surface of the needle clamp.

Further advantages and features will be apparent from the description of a preferred embodiment of the needle clamp and from the enclosed drawings in which:

FIG. 1 shows a portion of a sewing machine on which the needle clamp of the invention is applied;

FIG. 3 shows a side view of a guide member for fitting onto the clamp;

FIG. 6 shows a sectional view of the clamp taken along line 6—6 of FIG. 5.

Figure 2:
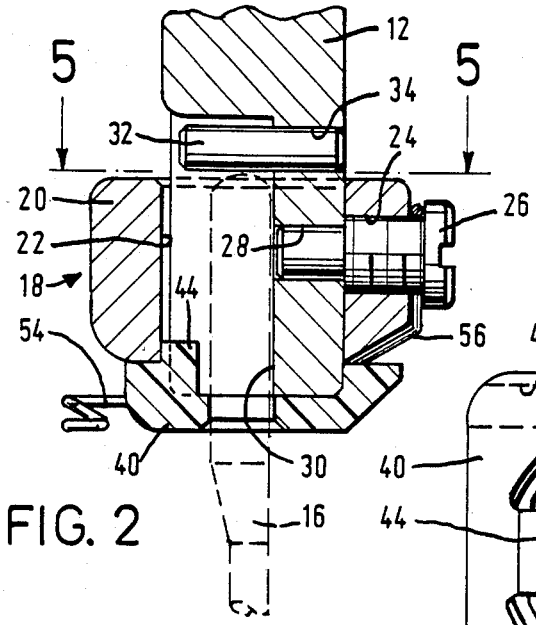
FIG. 2 shows a vertical sectional view of the needle clamp of the invention.

In FIG. 1 a sewing machine head 10 is shown along with needle bar 12 and presser bar 14 both of which are supported inside the head 10.

A needle 16 fixed to the lower portion of the needle bar 12 by means of a needle clamp 18 which is the object of the present invention and will be described in detail hereinafter.

With reference to FIG. 2 the needle clamp 18 comprises a body 20 having a longitudinal bore 22 suitable for coupling with the lower portion of the needle bar 12. A transverse threaded bore 24, in the body 20, fastens the needle clamp to the needle bar, by means of a pin screw 26 screwed into the bore 24 and couples by its pin portion with a transverse bore 28 in the needle bar 12 communicating with the usual needle groove 30 also provided in the needle bar for the housing of the needle 16. The needle 16 is mounted on the needle bar with the flat portion of its shank against the inside wall of the needle groove 30 by pushing upwardly until its upper end comes into contact with a pin 32 driven in the transverse hole 34 in the needle bar 12 slightly above clamp 18.

Figure 5:
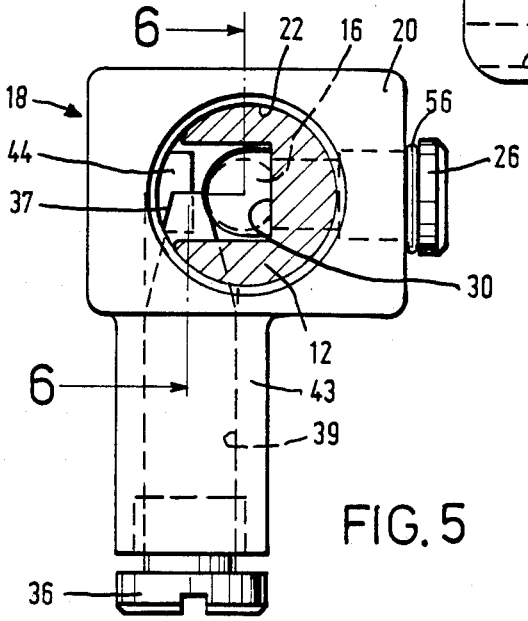
FIG. 5 shows a plan view of the needle clamp along line 5—5 of FIG. 2.

A pin 36 having a knurled head and a threaded shank (FIG. 5) has a frustum-shaped portion 37 provided to urge against the semicircular portion of the needle shank and fix the needle against the needle bar.

For this purpose, according to a system known in the art, needle groove 30, in the needle bar 12, has a transverse recess, not shown, for housing the frustum-shaped portion 37.

The knurled bolt 36 for the needle fastening 18 screwed into a threaded portion 39 in the projecting portion 43 of the needle clamp 18.

Figure 4:
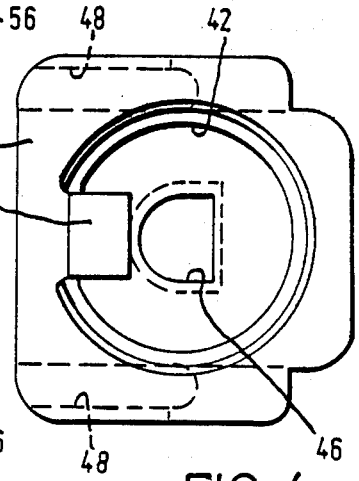
FIG. 4 shows a plan view of the guide of FIG. 3.

According to the object of the invention, in order to avoid the wrong assembling of the needle to the needle bar, a guide member 40 of plastic material is arranged in the lower portion of the needle clamp (FIGS. 3 and 4). The guide member 40, shown in side elevational and plan views in FIGS. 3 and 4, has a substantially square peripheral shape with a cylindrical opening 42 loosely coupling with the needle bar end, so as to allow small transverse displacements relative to the needle bar.

The tooth 44 is provided on the upper portion of guide 40 and fits into the needle groove 30 of needle bar 12, thereby ensuring correct mounting of the guide member 40 and avoiding the rotation thereof around its own vertical axis. As a continuation of the cylindrical opening 42 a central bore 46 is provided, having substantially the same shape as the transverse section of the needle shank but having a width as to allow the passage of a needle having a larger diameter when oriented like the shape of the bore and while preventing the passage of a needle with a smaller diameter when not oriented like the shape of the bore, that is when the flat surface of the needle shank does not match, in the mounting, with the flat surface of the bore.

The guide member 40 is supported by two arms 54 of an iron wire 56 fixed to the needle clamp by means of the same pin screw 26 as shown in FIGS. 2 and 6.

The two arms 54 engage the two parallel grooves 48 obtained in the lower portion of guide member 40 in such a way as to allow it to make the transverse displacements relative to the needle bar facilitating the needle mounting operations. In fact the needle can be placed on the mounting in a position rather different from the definitive and required one and reach the right one by actuating the knurled knob 36. The needle, pressed in such a way by the frustum-shaped portion 37, will reach the right position with its plane wall in contact with the plane wall 30 of the needle bar. The guide member 40 will follow the needle in its displacements due to the arrangement described heretofore.

What is claimed is:

1. A needle clamp for a sewing machine for fastening the shank portion of a needle in a predetermined position to a bottom portion of a needle bar, a separate guide member attached to a lower portion of said needle clamp and including a top surface with a cylindrical opening through which passes a grooved bottom portion of said needle bar, said guide member having a bottom surface with a hole therein through which passes said needle shank to lie within said needle bar groove, wherein said hole has substantially the same shape as a transverse section of the needle shank, and a tooth means extending into said cylindrical opening and engaging said needle bar groove to ensure correct alignment of said guide member with said needle clamp.

* * * * *